US005157945A

United States Patent [19]

Giehl

[11] Patent Number: 5,157,945

[45] Date of Patent: Oct. 27, 1992

[54] ARTICLE OF JEWELRY AND METHODS

[76] Inventor: Frank E. Giehl, 8 Tipton La., Willingboro, N.J. 08046

[21] Appl. No.: 719,989

[22] Filed: Jun. 24, 1991

[51] Int. Cl.[5] ..... A44C 25/00

[52] U.S. Cl. ..... 63/2; 63/23

[58] Field of Search ..... 63/1.1, 2, 23, 19, 20, 63/15.1, 15.2, 15.3, 15.4

[56] References Cited

U.S. PATENT DOCUMENTS

| | | | |
|---|---|---|---|
| 263,893 | 9/1882 | Goldsmith | 63/23 |
| 563,882 | 7/1896 | Rapaport | 63/19 |
| 788,425 | 4/1905 | Parris | 63/23 |
| 1,767,703 | 3/1931 | Solger | 63/1.1 |
| 1,792,534 | 2/1931 | German . | |
| 2,032,696 | 3/1936 | Goldblatt | 63/19 |
| 3,377,818 | 4/1968 | Marek | 63/19 |
| 4,542,631 | 9/1985 | Esser, III | 63/31 |
| 4,581,904 | 4/1986 | Lehmann et al. | 63/23 |

FOREIGN PATENT DOCUMENTS

| | | | |
|---|---|---|---|
| 261098 | 9/1963 | Australia | 63/23 |
| 758951 | 7/1933 | France | 63/2 |
| 1244156 | 12/1959 | France . | |
| 2254289 | 7/1975 | France | 63/2 |
| 2036538 | 7/1980 | United Kingdom . | |
| 2039455 | 8/1980 | United Kingdom | 63/23 |

*Primary Examiner*—Renee S. Luebke
*Assistant Examiner*—F. Saether
*Attorney, Agent, or Firm*—Thomas A. Lennox

[57] ABSTRACT

A heart shaped piece of jewelry is provided attachable to a chain. The body of the heart shape is in two parts separated along a jagged simulated broken line with guide members allowing the parts to be separated sliding along the guide members to simulate a break. A spring urges the parts to mate and a cam on the end of a member forces the parts to the separated condition by twisting the member followed by further twisting to close and re-mate the heart shape.

14 Claims, 2 Drawing Sheets

ARTICLE OF JEWELRY AND METHODS

BACKGROUND OF THE INVENTION

This invention relates to an article of jewelry and more particularly a piece of jewelry that may be worn on a chain.

The heart symbol has long been used in conjunction with expressions of love and caring. Conversely, the words "broken heart" or a symbol therefor has indicated a great unhappiness for either the loss of a relationship with another person or merely that the person is unhappy with actions or the absence thereof by a loved one.

Although jewelry in the form of lockets or other heart shapes are common, none have effectively depicted a "break" in the relationship and be able to be reconstructed to a full heart shape. In particular, none of the objects described hereinbelow have been attained by the jewelry in the prior art.

SUMMARY OF THE INVENTION

It is desired to provide a piece of expression jewelry that will convey a message that the person wearing it is either happy with the relationship with a loved one or, in the alternative, is unhappy with that relationship, either on a temporary or permanent basis. The articles of jewelry of the present invention is intended to convey a message and the "condition of the heart" can be adjusted to be either "whole" indicating that the person is satisfied with the relationship or in a "broken heart" condition indicating that the wearer is dissatisfied with the relationship. When wearing such jewelry feelings would be strongly expressed. Expressing ones feelings is a common problem and the message from the jewelry will immediately warn the observer, whether it be the offending loved one or a third party, that the person is distressed. Conversation, in any instances would not be necessary. The third party can, without getting involved in the details of the disrupted relationship of the wearer, take into account the mental state of the wearer. Further, the loved one whose mate is wearing a "broken heart" will quickly know that there is a problem in the relationship. In some relationships, where communication has become difficult, it is important to know as quickly as possible that there is a problem. By the use of the article of jewelry, a couple may more quickly resolve the differences and correct any deficiency in the relationship and in particular the communication between the parties.

It is therefore an object of the present invention to provide an article of jewelry that can be adjusted either to a "broken" condition readily visible to any observer and a "healed" or "unbroken" condition, also readily observable. This shape may be of any chosen exterior shape that is pleasing to the wearer and is preferably in the shape of a heart.

It is particularly preferred that the article of jewelry separate into two parts and yet have a durable connection between those two parts with a highly and easily viewed "break" between the two parts.

It is a further object of the present invention to provide an article of jewelry wherein the break between the two parts appears to simulate an actual break between the two parts rather than a straight line division between the two parts.

It is a particular object of the present invention that the two parts be adjusted to two positions, one that is open displaying the "break" and the other closed such that the exterior of the surface appears to be unbroken. This unbroken appearance may be achieved in a variety of ways including a surface pattern on the exterior surface of the article of jewelry.

It is a specific object of the present invention to combine attachment to a chain with the mechanism to open the break and close the break and that the opening mechanism be accomplished by twisting a member extending from the surface of the article and that the member be attachable to a chain which can be hung around the neck, around the person's wrist or any other exterior part of the body.

It is an additional object to provide a piece of jewelry that conveys emotion, both good and bad.

An aspect of the invention is an article of jewelry that includes a body including an exterior surface, an interior volume, and a plurality of separably parts of the whole. The parts mate together in a mated relationship to cause the exterior surface of the body to have the appearance of a whole integral shape. The article further includes guide means to maintain engagement of the two parts with each other when separated from each other to open a visible space between the parts and to guide the parts back to the mated relationship. The article also includes separating means to hold the parts in first and second positions, the first position being with the parts apart with the visible space between them, and the second position being with the parts mated to cause the exterior surface of the body to regain the appearance of the whole integral shape.

It is preferred that the separating means comprises a member include an interior end disposed in the interior volume of the body and an exposed end extending through the exterior surface of the body, to force the parts apart. It is further preferred that the separating means further include a cam on the interior end of the member and a follower surface on the interior volume of the body. It is more preferred that the follower surface be shaped and positioned to open the space between the parts upon a rotated turn of one hundred and eighty degrees of the member and close the space between the parts and mate the parts upon a further rotated turn of one hundred and eighty degrees of the member. It is further preferred that the member be rotatable in a plane of rotation and the cam be perpendicular to the plane of rotation. It is also preferred that the article of jewelry further include spring means to exert force on the parts to tend to maintain them in the mated relationship. It is further preferred that the article of jewelry further include means to attach the article of jewelry on a chain. It is also preferred that the means to attach the article of jewelry on a chain includes an opening through the exposed end of the member. It is further preferred that the exterior surface of the body be in the shape of a heart, there be two parts, and the visible space between the two parts be a jagged opening simulating a break between the two parts.

An aspect of the invention is an article of jewelry that includes a body that includes an exterior surface, an interior volume, and two separable parts of the whole. The two parts mate together in a mated relationship to cause the exterior surface of the body to have the appearance of a whole integral shape. The article further includes guide means to maintain engagement of the two parts with each other when separated from each other to open a visible space between the two parts and to guide the two parts back to the mated relationship. The article also includes separating means that includes a member that has an interior end disposed in the interior volume of the body and an exposed end extending through the exterior surface of the body. The separating means has the functions to force apart to open the visible space between the two parts, to hold the two parts apart with the visible space between them, and to release the two parts to allow the parts to mate to cause the exterior surface of the body to regain the appearance of a whole integral shape.

Another aspect of the invention is an article of jewelry that includes a body that includes an exterior surface in the shape of a heart, an interior volume, and two separable parts of the whole. The two parts mate together in a mated relationship to cause the exterior surface of the body to have the appearance of a whole integral heart shape. The article further includes guide means to maintain engagement of the two parts with each other when separated from each other to open a jagged visible space between the two parts simulating a break forming the two parts and to guide the two parts back to the mated relationship. The article also includes spring means to exert force on the two parts to tend to maintain them in the mated relationship. The article further includes separating means to includes a member extending from the interior volume outwardly through the exterior surface to force apart the two parts to open the visible space between the two parts, to hold the two parts apart with the visible space between them, and to release the two parts to allow the spring means to mate the parts to cause the exterior surface of the body to regain the appearance of a whole integral shape. The article also includes means to attach the exposed end of the member on a chain.

Another aspect of the invention is a method of providing the article of jewelry described hereinabove that includes providing the body as above, providing the guide means as above, and providing the separating means as above. Yet another aspect of the invention is a method of using the article of jewelry that includes providing the article of jewelry as above. The method of use further includes moving the member to cause the separating means to open the visible space between the two parts, allowing the parts to remain open for a chosen time interval, and moving the member to cause the separating means to close the visible space between the two parts and restore the exterior surface of the body to the appearance of a whole integral shape.

DESCRIPTION OF PREFERRED EMBODIMENTS

As should be clear, the shape of the article of jewelry is not critical to the invention although the heart shape is preferred. The shape of the heart is also not critical and while a rounded three-dimensional heart shape is illustrated in the figures, the heart shape may be constructed of a flat panel and may be essentially two-dimensional in shape. Particularly if the article is made of a precious metal, a brushed surface will hide and essentially make the division lines between the two separating halves invisible when the two halves are mated together.

Figure 1:
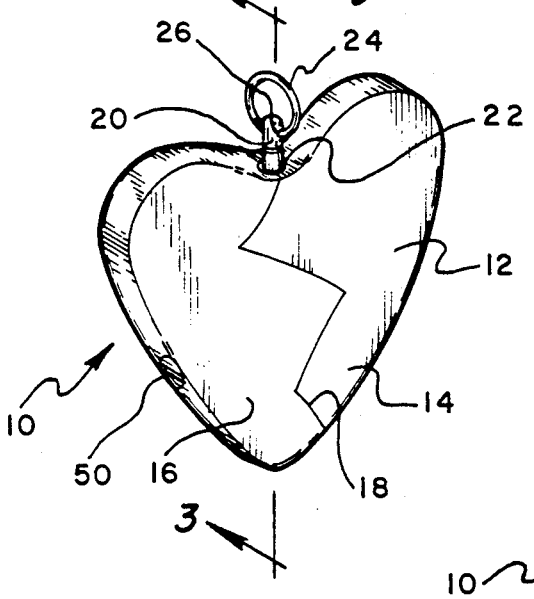
FIG. 1 is a perspective view of an article of jewelry according to the present invention in the closed "unbroken" position.
Figure 2:
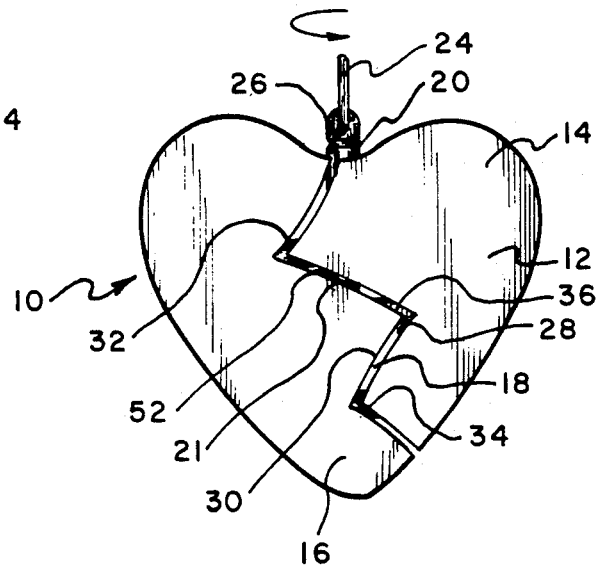
FIG. 2 is a front elevational view of the article of jewelry illustrated in FIG. 1 in the open "broken" position.

Article of jewelry 10 is illustrated in FIG. 1 shown in its unbroken and "healed" state with parts 14 and 16 mated together along jagged line 18 so that outer surface 12 is in a whole integral shape of a heart. As illustrated in FIG. 1, joint line 18 is visible, but it should be understood that this line may be totally invisible by the use of a heavy brushed or patterned surface over surface 12. Extending out through the center upper portion of the heart shape is post member 20 extending through circular opening 22 opening to the interior volume of the heart shape. Chain attachment ring 24 loops through horizontal hole 26 through the exposed end of post 20. As shown in FIG. 2, article 10 may be adjusted to the open or "broken" position. Post 20 has been rotated one hundred and eighty degrees such that dividing line 18 has become an open "crack" separating parts 14 and 16 and is easily observable by anyone approaching the wearer of the jewelry.

Figure 3:
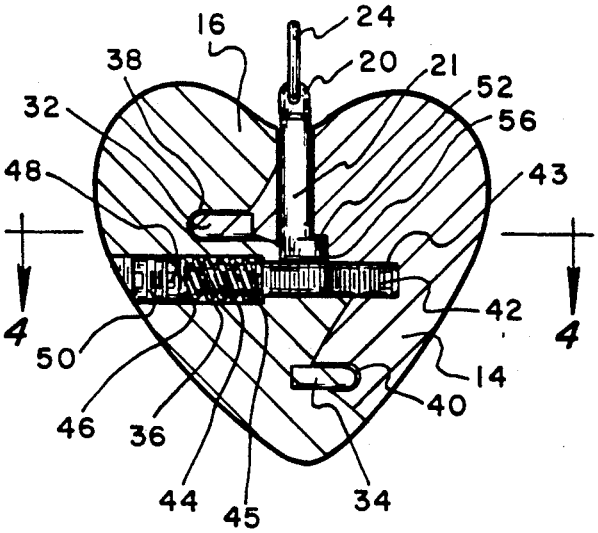
FIG. 3 is a vertical cross-sectional view taken along lines 3—3 of FIG. 1.
Figure 4:
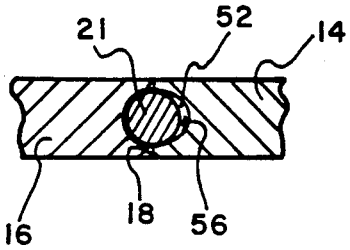
FIG. 4 is a partial cross-sectional view taken along lines 4—4 of FIG. 3.
Figure 5:
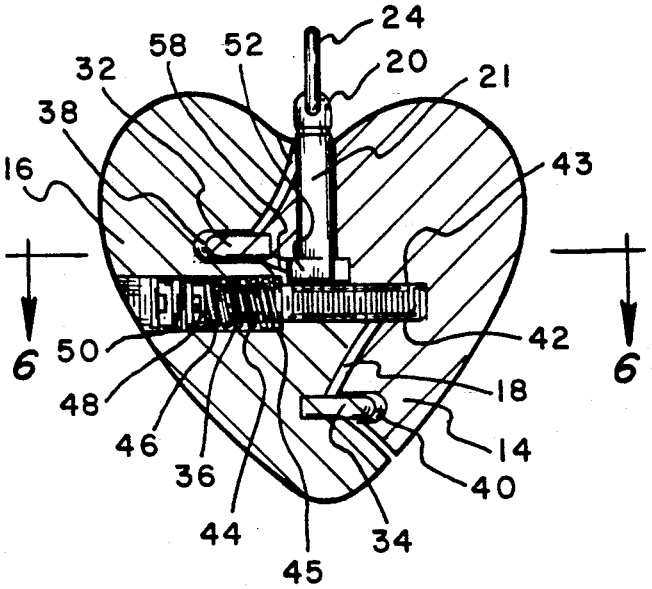
FIG. 5 is a vertical cross-sectional view of FIG. 2, taken along the same vertical plane as FIG. 3.
Figure 6:
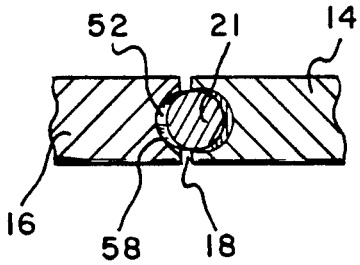
FIG. 6 is a cross-sectional view taken along lines 6—6 of FIG. 5.
Figure 7:
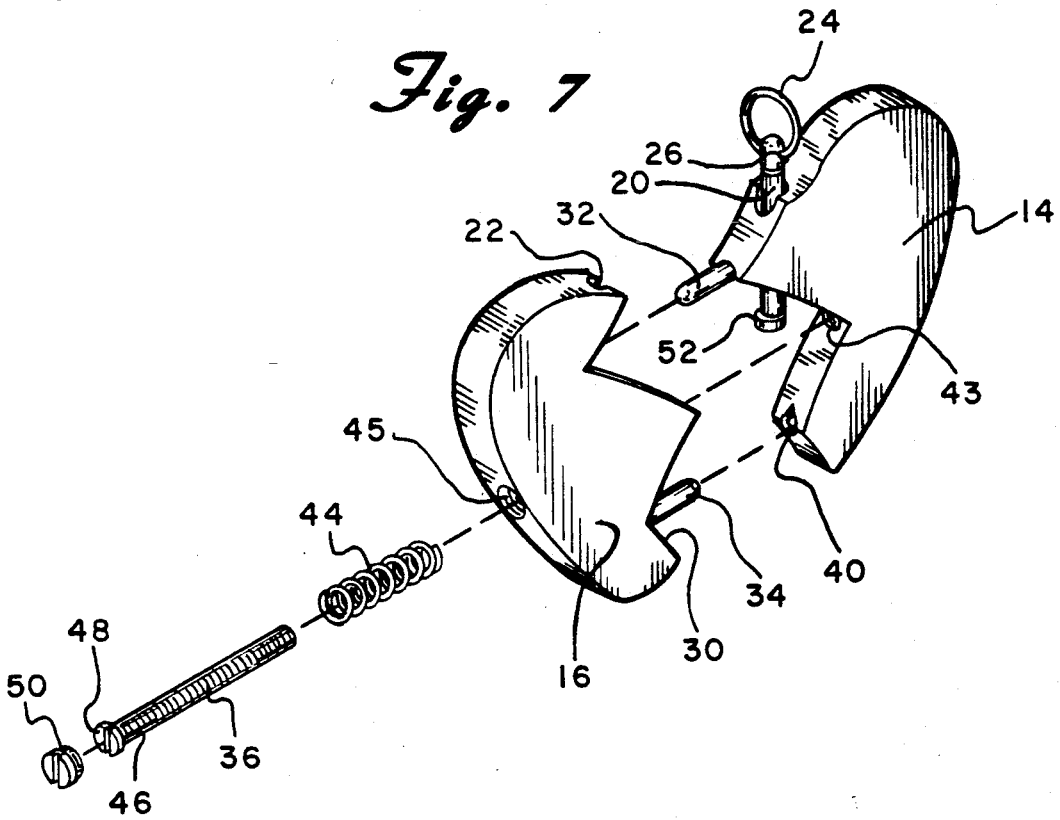
FIG. 7 is an exploded perspective view of the parts of the article illustrated in FIGS. 1 and 2.

Jagged joint edge 28 of part 14 and mating jagged joint edge 30 of part 16 are now separated opening dividing line 18 as a visible space. Although guide members 32, 34, and 36 which horizontally support parts 14 and 16 in their separated condition are visible in this view, they are mostly hidden and do not detract from the appearance. Since it is almost impossible to view the article of jewelry at an exact normal angle to opening 18, these guide members are normally hidden by the outside edge corners of edges 28 and 30. In FIG. 3, the vertical cross-sectional view shows horizontal guide members 32 and 34 extending from parts 14 and 16 respectively ride in horizontal guide bores 38 and 40 respectively hollowed out of parts 16 and 14 respectively. The outside diameters of guide members 32 and 34 are close fit tolerances riding freely in their respective guide bores. Attachment bolt 36 is threadably engaged in threads 42 hollowed out of part 16. Narrow bore 43 continues horizontally opening into part 14 and then expanding to larger bore 45 which opens to the outside left edge of part 16. Slotted head 48 of attachment bolt 36 capturing compression spring 44 against shoulder 46 formed by the changes in diameter between bores 43 and 45. Thus, attachment bolt 36 holds parts 14 and 16 together by the force of spring 44. Threaded cap 50 closes bores 45 to the outside surface 12. Post member 20 extends inwardly and downwardly into the internal volume of article 10 with section 21 of post 20 being the lower terminal section inside the volume. Pin member cam 52 extends horizontally in essentially one direction from section 21 in a cavity towards cam follower surface 56 which does not engage the cam and allows article 10 to close along dividing line 18. Cam follower surface 58 is proximate the exterior surface of section 21 of post 20. As shown in FIG. 4, cam 52 does not quite touch surface 56 allowing parts 14 and 16 to be urged together along dividing line 18. As shown in FIG. 5, post 20 and lower section 21 have been rotated one hundred and eighty degrees urging cam 52 against cam follower surface 58 opening dividing line 18 as a space. Upper guide pin 32, lower guide pin 34 and attachment bolt 36 all ride in their respectively bores with close tolerances to hold the part in this second open position. FIGS. 6 shows can 52 engaging follower surface 58 opening space 18 between parts 14 and 16. FIG. 7 shows lower guide bore 40 and narrow bore 43 extending the latter into both parts 14 and 16, and attachment bolt 36 exploded to show the various parts.

Heart 10 can be constructed of precious metal including not only gold and silver but base metals plated with precious and durable metals. Article 10 can also be constructed of a thermoplastic polymer including engineering plastic such as polycarbonate, nylon, Delrin, which may be colored a bright red to simulate a heart color. In the embodiments molded of plastic, parts 14 and 16 may be injection molded. Again, pattern surfaces, even on the plastic molded parts make dividing line 18 essentially invisible.

Other internal constructions may be used to construct the article. For example, a double detent system may be utilized wherein the two parts are urged together by a detent essentially snapping the two parts together. When the two parts are pulled apart, they are pulled into a second detent condition where the two parts are held in position by the second detent separated apart. The guide members may incorporate the detents. The article may also be constructed with three or more separable parts. The parts may be separated by individual detents holding them in their respective positions apart or in the joined integral condition. In the multiple part embodiment, the cam operated version of the device may have more than one cam follower surface that separates the parts pushing them apart against a spring or multiple springs holding the plurality of parts together.

While this invention has been described with reference to the specific embodiments disclosed herein, it is not confined to the details set forth and the patent is intended to include modifications and changes which may come within and extend from the following claims.

I claim:

1. An article of jewelry comprising:

(a) a body comprising an exterior surface, an interior volume, and a plurality of separable parts of the body, wherein the parts mate together in a mated relationship to cause the exterior surface of the body to have the appearance of a whole integral shape, (b) guide means to maintain engagement of two of the parts with each other when separated from each other to open a space between the parts to allow an open view through the body through the space between the two parts and to guide the parts back to the mated relationship, and (c) separating means to hold the parts in first and second positions, the first position being with the parts apart with the space between them, and the second position being with the parts mated to cause the exterior surface of the body to regain the appearance of the whole integral shape, wherein the separating means comprises a member comprising an interior end disposed in the interior volume of the body and an exposed end extending through the exterior surface of the body, to force the parts apart.

2. The article of jewelry of claim 1 wherein the separating means further comprises a cam on the interior end of the member and a follower surface on the interior volume of the body.

3. The article of jewelry of claim 2 wherein the follower surface is shaped and positioned to open the space between the parts upon a rotated turn of one hundred and eighty degrees of the the member and close the space between the parts and mate the parts upon a further rotated turn of one hundred and eighty degrees of the member.

4. The article of jewelry of claim 2 wherein the member is rotatable in a plane of rotation and the cam is perpendicular to the plane of rotation.

5. The article of jewelry of claim 2 further comprising spring means to exert force on the parts to tend to maintain them in the mated relationship.

6. The article of jewelry of claim 1 further comprising spring means to exert force on the parts to tend to maintain them in the mated relationship.

7. The article of jewelry of claim 1 further comprising means to attach the article of jewelry on a chain.

8. The article of jewelry of claim 7 wherein the means to attach the article of jewelry on a chain comprises an opening through the exposed end of the member.

9. The article of jewelry of claim 1 wherein the exterior surface of the body is in the shape of a heart, there are two parts, and the visible space between the two parts is a jagged opening simulating a break between the two parts.

10. An article of jewelry comprising:

(a) a body comprising an exterior surface in the shape of heart, an interior volume, and two separable parts of the body, wherein the two parts mate together in a mated relationship to cause the exterior surface of the body to have the appearance of a whole integral shape, (b) guide means to maintain engagement of the two parts with each other when separated from each other to open a space between the two parts to allow an open view through the body through the space between the two parts and to guide the two parts back to the mated relationship, and (c) separating means comprising a member comprising an interior end disposed in the interior volume of the body and an exposed end extending through the exterior surface of the body to:

(i) force apart the two parts to open the visible space between the two parts, (ii) hold the two parts apart with the visible space between them, and (iii) release the two parts to allow the parts to mate to cause the exterior surface of the body to regain the appearance of a whole integral shape.

11. The article of jewelry of claim 10 further comprising spring means to exert force on the two parts to tend to maintain them in the mated relationship.

12. The article of jewelry of claim 11 wherein the separating means further comprises a cam on the interior end of the member and a follower surface on the interior volume of the body.

13. An article of jewelry comprising:

(a) a body comprising an exterior surface in the shape of a heart, an interior volume, and two separable parts of the body, wherein the two parts mate together in a mated relationship to cause the exterior surface of the body to have the appearance of a whole integral heart shape, (b) guide means to maintain engagement of the two parts with each other when separated from each other to open a jagged space between the two parts to allow an open view through the body through the space between the two parts simulating a break forming the two parts and to guide the two parts back to the mated relationship, (c) spring means to exert force on the two parts to tend to maintain them in the mated relationship, (d) separating means comprising a member extending from the interior volume outwardly exposing an end of the member through the exterior surface to:

(i) force apart the two parts to open the jagged visible space between the two parts, (ii) hold the two parts apart with the jagged visible space between them, and (iii) release the two parts to allow the spring means to mate the parts to cause the exterior surface of the body to regain the appearance of a whole integral heart shape, and (e) means to attach the exposed end of the member on a chain.

14. A method of using an article of jewelry comprising:

(A) providing an article of jewelry comprising:

(i) a body comprising an exterior surface, an interior volume, and two separable parts of the body, wherein the two parts mate together in a mated relationship to cause the exterior surface of the body to have the appearance of a whole integral shape, (ii) guide means to maintain engagement of the two parts with each other when separated from each other to open a space between the two parts to allow an open view through the body through the space between the two parts and to guide the two parts back to the mated relationship, and (iii) separating means comprising a member comprising an interior end disposed in the interior volume of the body and an exposed end extending through the exterior surface of the body to:

(a) force apart to open the space between the two parts, (b) hold the two parts apart with the space between them, and (e) release the two parts to allow the parts to mate to cause the exterior surface of the body to regain the appearance of a whole integral shape, (B) moving the member to cause the separating means to open the space between the two parts, (C) allowing the parts to remain open for a chosen time interval, and (D) moving the member to cause the separating means to close the space between the two parts and restore the exterior surface of the body to the appearance of a whole integral shape.

* * * * *